US006129976A

United States Patent [19]

Mizushima et al.

[11] Patent Number: 6,129,976

[45] Date of Patent: Oct. 10, 2000

[54] EXOTHERMIC INSTRUMENT FOR FIRING EXPLOSIVE

[75] Inventors: Kiyoshi Mizushima; Mamoru Mouri; Motoharu Miyakoshi; Satoshi Nakamura, all of Ishikawa; Hiroshi Sato, Saitama; Shinzo Tsuji, Saitama; Masashi Watanabe, Saitama; Eiji Arai, Saitama, all of Japan

[73] Assignees: Nikko Company, Ishikawa; Nichiyu Giken Kogyo Co., Ltd., Saitama, both of Japan

[21] Appl. No.: 09/038,257

[22] Filed: Mar. 10, 1998

[30] Foreign Application Priority Data

Mar. 11, 1997 [JP] Japan ..... 9-055719

[51] Int. Cl.[7] ..... B32B 3/00; H05K 1/16; F42B 3/10

[52] U.S. Cl. ..... 428/209; 428/210; 428/901; 102/202.5; 102/202.7; 102/202.8; 102/202.9; 102/202.14; 174/260

[58] Field of Search ..... 428/34.4, 209, 428/210, 901; 174/260; 361/748, 750–752; 102/202.5, 202.7, 202.9, 202.14, 202.8

[56] References Cited

U.S. PATENT DOCUMENTS

| | | | |
|---|---|---|---|
| 2,882,820 | 4/1959 | Young . | |
| 2,986,090 | 5/1961 | Doerpinghaus . | |
| 4,246,672 | 1/1981 | Fujiyama et al. | 9/321 |
| 4,729,315 | 3/1988 | Proffit et al. . | |
| 4,795,670 | 1/1989 | Nishigaki et al. | 428/209 |
| 4,835,038 | 5/1989 | Kaneko et al. | 428/209 |
| 4,944,225 | 7/1990 | Barker . | |
| 5,145,803 | 9/1992 | Daimer et al. . | |
| 5,243,492 | 9/1993 | Marquit et al. . | |
| 5,256,836 | 10/1993 | Ezaki | 174/260 |
| 5,543,586 | 8/1996 | Crane, Jr. et al. . | |
| 5,574,311 | 11/1996 | Matsuda . | |
| 5,905,226 | 5/1999 | Baginski | 102/202.2 |

FOREIGN PATENT DOCUMENTS

| | | |
|---|---|---|
| 0164313 | 12/1998 | European Pat. Off. . |
| 2840738 | 2/1980 | Germany . |
| 2945803 | 5/1981 | Germany . |
| 9624024 | 8/1996 | WIPO . |

*Primary Examiner*—Timothy Speer
*Assistant Examiner*—Bryant Young
*Attorney, Agent, or Firm*—Reed Smith Shaw & McClay LLP

[57] ABSTRACT

The exothermic instrument for firing an explosive comprises a circuit board 1 having a heat resist layer 6 on a substrate 11 and an exothermic resistance 4, which connects to a pair of through hole conductive electrodes 13 passing through the substrate 11, contacting with the explosive 19 on the heat resist layer 6, a pair of electrode pins 8, each one thereof is inserted into each one of the through hole conductive electrodes, and an insulator for holding the circuit board 1 through which the electrode pins 8 pass.

6 Claims, 2 Drawing Sheets

EXOTHERMIC INSTRUMENT FOR FIRING EXPLOSIVE

BACKGROUND OF THE INVENTION

The present invention relates to an exothermic instrument for firing an explosive used to fire a squib loaded, for example, with powder and a circuit board used for such an exothermic instrument as well as to a manufacturing method of the circuit board.

Some gas generators have been used as a driving source for such devices requiring large instantaneous motive power as air bags and seat belts for automobiles. The gas generator has a squib and gas generating agent, for example, the mixture of sodium azide and metal oxide with nitrate or perchlorate and reducing agent. The squib incorporates an exothermic instrument comprising an exothermic resistance and electrode pins communicating therewith, and an explosive. When an electric current is made to flow into the exothermic resistance from the electrode pins in the squib, the exothermic resistance generates heat, activating the squib to ignite the explosive. The combustion of the explosive in the squib thus induces the activation of the gas generating agent, which generates a large amount of gas within an extremely short time to inflate an air bag. The gas generating power also drives instantaneously any device that is linked thereto.

Japanese Patent Provisional Publication No. 5-133699 discloses a conventional squib. The squib connects a pair of electrodes formed on a surface of an insulating sheet with an exothermic resistance made of a metal film. The exothermic resistance of the metal film is made to contact directly the ceramic substrate of the insulating sheet.

SUMMARY OF THE INVENTION

The primary purpose of the present invention is to provide an exothermic instrument for an explosive ignition that acts assuredly with a constant electric current. To achieve the purpose, the exothermic instrument for firing an explosive by the present invention comprises a circuit board having a heat resist layer on a substrate and an exothermic resistance, which connects to a pair of through hole conductive electrodes passing through the substrate, contacting with the explosive on the heat resist layer, a pair of electrode pins, each one thereof is inserted into each one of the through hole conductive electrodes, and an insulator for holding the circuit board through which the electrode pins pass.

In the present exothermic instrument for firing an explosive, the circuit board and the insulator are preferably housed in a cylindrical body stuffing the explosive.

The secondary purpose of the present invention is to provide a circuit board for being installed into the exothermic instrument. To achieve the purpose, the circuit board for being installed into the exothermic instrument by the present invention comprises a substrate made of a ceramics, each one of a pair of through hole conductive electrodes formed on each inner face of a pair of holes passing through covering over of a circumferential periphery thereof, the heat resist layer made of a glass or a glass ceramics provided on at least a part of the substrate and the exothermic resistance, connecting to the pair of the conductive electrodes, on the heat resist layer.

In the present circuit board for being installed into the exothermic instrument, the heat resist layer may preferably contain boron-silicate-lead glass. More preferably the heat resist layer is formed from baking of a mixture including alumina ceramic powder and boron-silicate-lead glass.

The third purpose of the present invention is to provide a manufacturing method of the circuit board for being installed into the exothermic instrument. To achieve the purpose, the manufacturing method of the circuit board by the present invention comprises a step for making a substrate as large as plural objective circuit boards having pairs of holes passing through by each one of the objective circuit boards, a step for forming heat resist layers of a glass or glass ceramics on the middle portion of the pair of holes at a pitch of the objective circuit board on the substrate, a step for forming pairs of conductive electrodes, each and all of those conductive electrodes on an inner face of each hole and through covering over the circumferential periphery of the each hole, a step for forming an exothermic resistances on each one of the heat resist layers connecting to the pair of conductive electrodes and a step for separating plural circuit boards into each one thereof.

In the present manufacturing method, it is preferred that the substrate is made of a ceramics on which grid-like grooves are formed to cut off along the grooves for the separating the plural circuit boards. Moreover, it is preferred that each and all pair holes pass through on each line for the separating the plural circuit boards.

DETAILED EXPLANATION OF THE INVENTION

Embodiments would be described, which are preferable ones of the present invention, referring to figures and, however, is to be used to understand the present invention but should not be used for the present invention to be limited.

Figure 1:
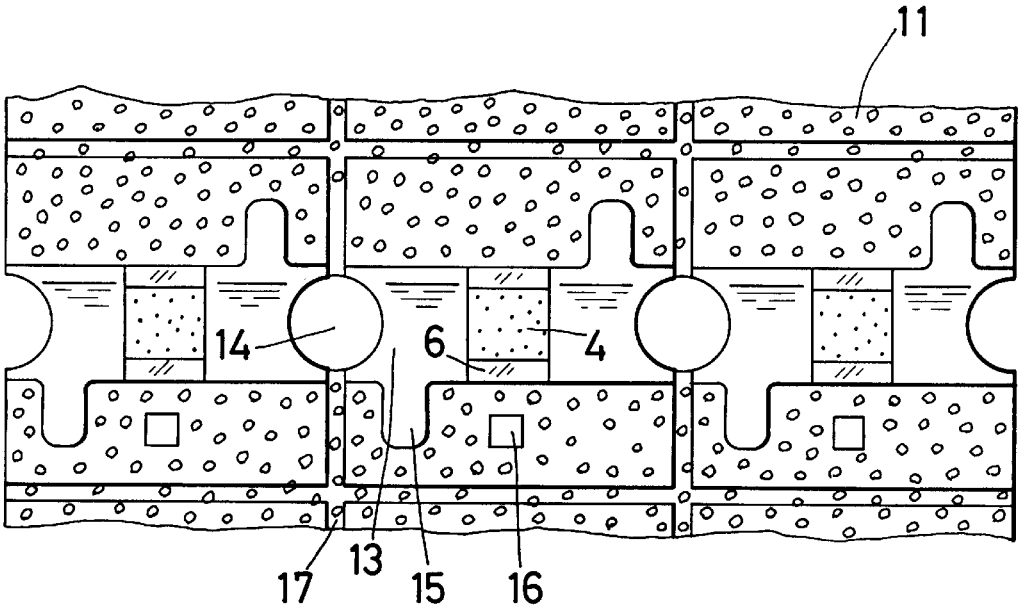
FIG. 1 is a plane view of an embodiment of a midway-to-manufacturing of the circuit board for being installed into the exothermic instrument of the present invention.

FIG. 1 is a top plane view of a midway-to-manufacturing circuit board for an exothermic instrument for firing explosive. In the circuit board, a punching operation forms simultaneously the grid-like grooves 17 that isolate horizontally and vertically the surface of an alumina green sheet, the raw material of the ceramic substrate 11, into grids, and the round holes 14 centered on the grooves 17. Baking of this green sheet will give the ceramic substrate 11.

A heat resist layer 6 made of glass ceramics is printed a on the ceramic substrate 11 by a screen printing method and then is baked. A silver palladium, the raw material of the conductive electrodes 13 is printed, also by a screen process, in the circumferential periphery of the round holes 14 in the ceramic substrate 11. At the same time, the silver palladium is absorbed from the reverse side of the ceramic substrate 11 into the inner wall of the round holes 14 to form the through hole conductive electrodes 13. The conductive electrode 13 has a convex portion 15 to which will be attached a resistance value measuring terminal when trimming the exothermic resistance 4. The ceramic substrate 11 with the silver palladium printed will then be baked.

Printed also by the screen process on the heat resist layer 6 of the ceramic substrate 11 will be the exothermic resistance 4 made of ruthenium oxide ($RuO_2$). After the simultaneous printing of the mark 16, the substrate 11 will be baked again with the mark 16. With the position recognized with the mark 16, the exothermic resistance 4 will be trimmed, by laser beam, into predetermined resistance value.

Then, manual splitting and isolation of the ceramic substrate 11 all along the grid-like grooves 17 will allow to get the circuit board for explosive igniting exothermic instrument with concave portions formed from a pair of round holes 14.

Figure 2:
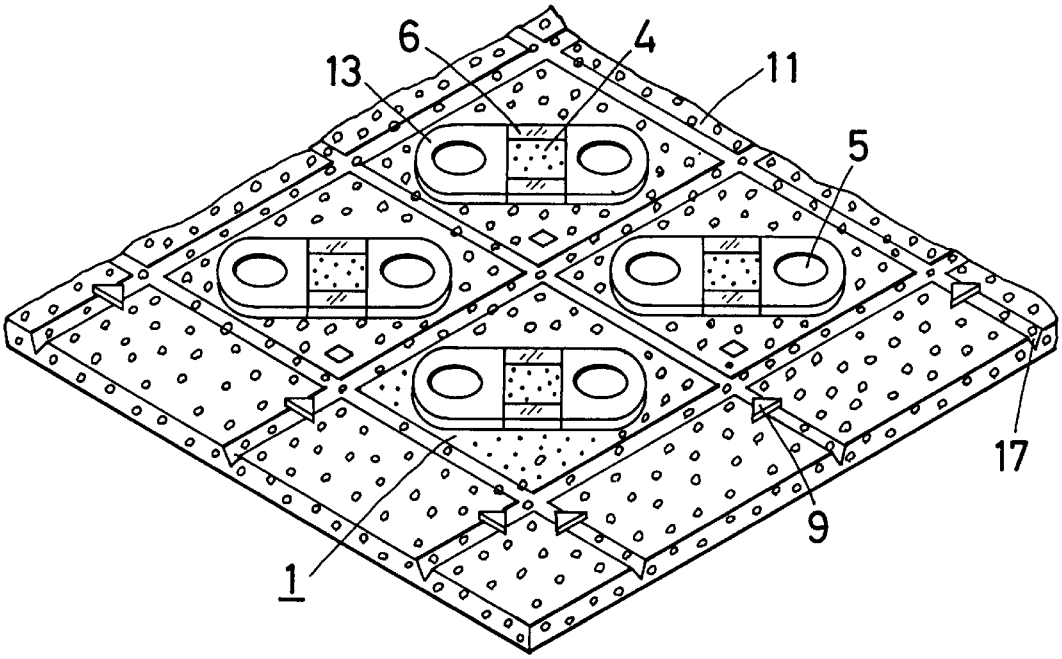
FIG. 2 is a perspective view of another embodiment of a midway-to-manufacturing the circuit board for being installed into the exothermic instrument of the present invention.

FIG. 2 is a perspective view of another midway-to-manufacturing circuit board 1 for an exothermic instrument for explosive firing to which this invention applies. In the circuit board 1 for the explosive firing exothermic instrument, a punching operation forms simultaneously the grid-like grooves 17 and round holes 5 on an alumina green sheet, the raw materials of the ceramic substrate 11, to divide the sheet into a hundred 5 mm x 5 mm square grids. This green sheet is baked into the ceramic substrate 11.

Printed, by the screen process, and baked on the ceramic substrate 11 will be a heat resist layer 6 made of boron-silicate glass. A silver palladium, the raw material of the conductive electrodes 13 is printed, also by screen process, in the circumferential periphery of the round holes 5 in the ceramic substrate 11. At the same time, the silver palladium is absorbed from the reverse side of the ceramic substrate 11 into the inner wall of the round holes 5 to form the through hole conductive electrodes 13. Printed at the same time on the grooves 17 will be triangular metal marks 9, which will serve as tick marks when dividing the ceramic substrate 11. The ceramic substrate 11 thus printed will then be baked.

Printed also by the screen process on the heat resist layer 6 of the ceramic substrate 11 will be the exothermic resistance 4 made of ruthenium oxide ($RuO_2$). The substrate 11 will be baked again. Then, manual splitting and isolation of the ceramic substrate 11 along the grid-like grooves 17 will allow to have the circuit board 1 for explosive firing exothermic instrument.

After baking the alumina green sheet, the ceramic substrate 11 may have the round holes 5 opened and grooves 17 formed, both by laser beam.

Figure 3:
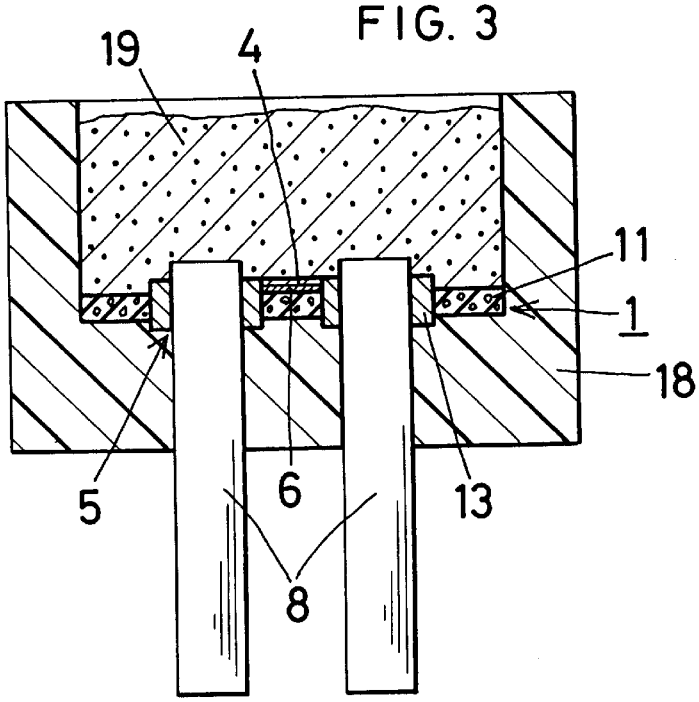
FIG. 3 is a cross sectional view of an embodiment of an exothermic instrument for firing explosive of the present invention.

FIG. 3 shows an exemplary exothermic instrument for explosive firing that uses the circuit board 1 thus manufactured. As shown in this figure, the exothermic instrument is housed in the insulating container 18. A pair of electrode pins 8 pass through the bottom of the insulating container 18 to be inserted into the round hole of the circuit board 1 for explosive igniting exothermic instrument. The explosive 19 is loaded into the insulating container 18.

The explosive igniting exothermic instrument acts as follows. When the electrode pins 8 are connected to a power supply to flow an electric current, the exothermic resistance 4 of the circuit board 1 for explosive igniting exothermic instrument gets heated to ignite and combust the explosive 19. The heat emanating from the exothermic resistance 4 is kept from dissipating over the ceramic substrate 11 due to the existence of the heat resist layer 6, and is therefore transferred efficiently to the explosive 19, which will thus be ignited assuredly.

Figure 4:
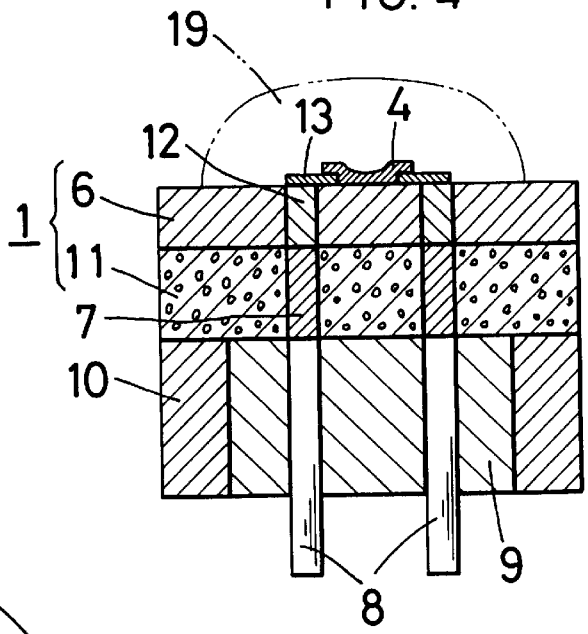
FIG. 4 is a cross sectional view of another embodiment of an exothermic instrument for firing explosive of the present invention.
Figure 5:
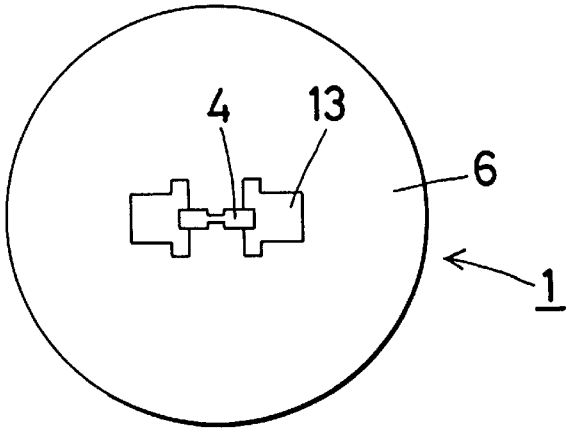
FIG. 5 is a plane view of the exothermic instrument for firing explosive as shown in FIG. 4.

FIGS. 4 and 5 are the cross sectional and plan views, respectively, of another exemplary exothermic instrument for explosive firing to which this invention applies.

As shown in these figures, two electrode pins 8 in the exothermic instrument pass through the insulator 9 packed into the metal cylinder 10. Laminated on the insulator 9 are the base substrate 11 made of ceramics and the heat resist layer 6 made of glass or glass ceramics. The tip of the electrode pin 8 is connected with the though hole silver-based electric conductor 7 loaded into the holes opened in the base substrate 11, while the conductor 7 is connected to the through hole silver-based electric conductor 12 loaded into the holes opened in the heat resist layer 6. The tip of the conductor 12 is connected with the terminal electrode 13 fixed on the heat resist layer 6, while the terminal electrode 13 is bridged by the exothermic resistance 4 with its neck-formed central part. The explosive 19 is applied on the exothermic resistance 4 in such a fashion that the former envelopes the latter. The electrode pins 8 are connected to a power supply (not shown).

What is claimed is:

1. A circuit board for being installed into an exothermic instrument comprising:

a substrate made of a ceramic material, each one of a pair of through hole conductive electrodes formed on each inner face of a pair of holes passing through covering over of a circumferential periphery thereof;

a heat resist layer made of a glass or a glass ceramic material provided on at least a part of the substrate, and an exothermic resistance layer, connecting to the pair of the conductive electrodes, on the heat resist layer, wherein the heat resist layer contains a boron-silicate-lead glass.

2. The circuit board as claimed in claim 1, characterized in that the heat resist layer is formed from baking of a mixture including alumina ceramic powder and boron-silicate-lead glass.

3. An exothermic instrument for firing an explosive comprising:

a circuit board having an exothermic resistance layer on a heat resist layer formed on a substrate, the exothermic resistance layer connects to a pair of through hole conductive electrodes passing through the substrate and contacts with the explosive, a pair of electrode pins, each one thereof is inserted into each one of the through hole conductive electrodes, and an insulator for holding the circuit board through which the electrode pins pass.

4. The exothermic instrument of claim wherein the exothermic resistance layer is formed from ruthenium oxide.

5. The exothermic instrument as claimed in claim 1, characterized in that the circuit board and the insulator are housed in a cylindrical body for containing the explosive.

6. A circuit board for being installed into an exothermic instrument comprising:

a substrate made of a ceramic material, each one of a pair of through hole conductive electrodes formed on each inner face of a pair of holes passing through covering over of a circumferential periphery thereof;

a heat resist layer made of a glass or a glass ceramic material provided on at least a part of the substrate, and an exothermic resistance layer, connecting to the pair of the conductive electrodes, on the heat resist layer, wherein the exothermic resistance layer is formed from ruthenium oxide.

* * * * *